US007604455B2

(12) United States Patent
Paprotna et al.

(10) Patent No.: US 7,604,455 B2
(45) Date of Patent: Oct. 20, 2009

(54) ROTOR DISC ASSEMBLY WITH ABRASIVE INSERT

(75) Inventors: Hubertus E. Paprotna, Winter Springs, FL (US); David B. Allen, Oviedo, FL (US); Oran L. Bertsch, Titusville, FL (US)

(73) Assignee: Siemens Energy, Inc., Orlando, FL (US)

( * ) Notice: Subject to any disclaimer, the term of this patent is extended or adjusted under 35 U.S.C. 154(b) by 462 days.

(21) Appl. No.: 11/504,449

(22) Filed: Aug. 15, 2006

(65) Prior Publication Data

US 2008/0044278 A1 Feb. 21, 2008

(51) Int. Cl.
*F01D 11/00* (2006.01)

(52) U.S. Cl. ..... 415/173.1; 415/173.4; 415/199.5

(58) Field of Classification Search ..... 415/173.4, 415/174.4, 199.5, 173.1; 416/215, 248
See application file for complete search history.

(56) References Cited

U.S. PATENT DOCUMENTS 3,846,899 A * 11/1974 Gross ..... 29/402.02
3,932,056 A 1/1976 Tai
4,251,185 A 2/1981 Karstensen
4,289,446 A 9/1981 Wallace
4,536,127 A 8/1985 Rossmann et al.
4,706,354 A 11/1987 Naudet et al.
4,773,817 A 9/1988 Stangalini et al.
5,380,155 A 1/1995 Varsik et al.
5,482,433 A 1/1996 Norris et al.
5,785,492 A 7/1998 Belsom et al.
5,997,248 A * 12/1999 Ghasripoor et al. ..... 415/173.4
6,390,771 B1 5/2002 Gervais et al.
6,514,041 B1 2/2003 Matheny et al.
2004/0062637 A1 4/2004 Dube et al.
2004/0219024 A1 11/2004 Soupizon et al.

FOREIGN PATENT DOCUMENTS

GB 2 112 878 A 7/1983

* cited by examiner

*Primary Examiner*—Edward Look
*Assistant Examiner*—Ryan H Ellis

(57) ABSTRACT

Aspects of the invention are directed to a system for improving engine performance by reducing vane tip clearances in the compressor section of a turbine engine. According to aspects of the invention, an abrasive material can be attached to a rotor disc. Thus, if a vane tip contacts the rotor disc during engine operation, the vane tip is worn away by the abrasive material. The system can reduce the risk of substantial component damage resulting from a vane tip rubbing event. The abrasive material can be provided in the form of an insert that can be removably attached to the rotor disc. Thus, the insert can be readily removed and replaced when necessary.

16 Claims, 6 Drawing Sheets

ROTOR DISC ASSEMBLY WITH ABRASIVE INSERT

FIELD OF THE INVENTION

The invention relates in general to turbine engines and, more particularly, to vane tip clearance control in the compressor section of a turbine engine.

BACKGROUND OF THE INVENTION

As shown in FIG. 1, the compressor section 10 of a turbine engine is enclosed within an outer casing 12. The compressor can include a rotor 11 (partially shown) with a plurality of axially spaced discs 14. Each disc 14 can host a row of rotating airfoils, commonly referred to as blades 16. The rows of blades 16 alternate with rows of stationary airfoils or vanes 18. The vanes 18 can be mounted in the compressor section 10 in various ways. For example, one or more rows of vanes 18 can be attached to and extend radially inward from the compressor casing 12. In addition, one or more rows of vanes 18 can be hosted by a blade ring or vane carrier 20 and extend radially inward therefrom.

The compressor section 10 contains several areas in which there is a gap or clearance between the rotating and stationary components. During engine operation, fluid leakage through such clearances contributes to system losses, decreasing the operational efficiency of the engine. FIG. 2 shows one area in which fluid leakage can occur. As shown, a clearance 22 is defined between the tips 24 of the compressor vanes 18 and the substantially adjacent rotating structure, such as the rotor disc 14. Ideally, the clearance 22 is kept as small as possible, for it would result in an increase in engine performance. However, it is critical to maintain a clearance between the rotating and stationary components at all times. Rubbing of any of the rotating and stationary components can lead to substantial component/engine damage, performance degradation, and extended outages.

The size of the clearance 22 can change during engine transient operation due to differences in the thermal inertia of the rotor and discs 14 compared to the thermal inertia of the stationary structure, such as the outer casing 12 or the vane carrier 20, to which the vanes 18 are connected. The thermal inertia of the stationary structure (outer casing 12 and/or the vane carrier 20) is significantly less than the rotating structure (rotor and/or the discs 14). Thus, the stationary structure has a faster thermal response time and responds (through expansion or contraction) more quickly to a change in temperature than the rotating structure. These differences in thermal inertia give rise to the potential for vane tip rubbing.

Prior efforts have sought to avoid vane tip rubbing. To that end, large tip clearances 22 are initially provided so that the vane tips 24 do not rub during non-standard engine conditions where the clearances 22 would otherwise be expected to be the smallest. Examples of such non-standard operating conditions include hot restart (such as, restarting the engine soon after shutdown, spin cool, etc.). However, because the minimum tip clearances 22 are sized for these off design conditions, the clearances 22 become overly large during normal engine operation, such as at base load. Consequently, the compressor and the engine overall can experience measurable performance decreases in power and efficiency due to tip clearance leakage.

Thus, there is a need for a system that can improve engine performance by minimizing vane tip clearances.

SUMMARY TO THE INVENTION

Aspects of the invention are directed to a rotor disc assembly. The assembly includes a turbine engine rotor disc. The disc has an outer peripheral surface. An abrasive material is attached to the rotor disc so as to form a portion of the outer peripheral surface. In one embodiment, at least a portion of the abrasive material can protrude beyond the outer peripheral surface of the rotor disc. The abrasive material can be provided at two or more locations on the rotor disc. In such cases, the abrasive material can be substantially equally spaced about the outer peripheral surface of the rotor disc. The abrasive material can extend substantially axially along the rotor disc.

The abrasive material can be one or more of the following: cubic boron nitride, silicon carbide, silicon nitride, alumina, zirconia or diamond. The abrasive material can have an associated Mohs hardness of at least about 9.

The abrasive material can be attached to a base to form an insert. The insert can be removably attached to the rotor disc. For instance, the disc can include a substantially axially extending slot. The slot can open to the outer peripheral surface of the disc. The insert can be retainably received in the slot. The insert can be substantially circumferentially and substantially radially restrained in the slot. In one embodiment, the base and the slot can be configured as dovetails.

The insert can be restrained in the axial upstream direction and/or the axial downstream direction. In one embodiment, such restraint can be achieved by providing a transverse protrusion on the base and by contouring the slot such that the slot substantially matingly engages the protrusion.

In another respect, aspects of the invention concern a vane tip clearance system. The system includes a rotating disc that has an outer peripheral surface. The disc has a slot, which opens to the outer peripheral surface of the disc. The system also includes an insert with a base and an abrasive material attached to the base. The abrasive material can be one or more of the following: cubic boron nitride, silicon carbide, silicon nitride, alumina, zirconia or diamond. The abrasive material can have an associated Mohs hardness of at least about 9.

The insert is retainably received in the slot such that the abrasive material is at least flush with the outer peripheral surface of the disc. In one embodiment, the abrasive material can protrude beyond the outer peripheral surface of the disc. When received in the slot, the insert can extend in substantially the axial direction along the rotor disc.

In one embodiment, the base can include a transverse protrusion, and the slot can be contoured to substantially matingly engage the protrusion. Such engagement can retain the insert in the axial upstream direction and/or the axial downstream direction. Alternatively or in addition, the base and the slot can be configured as dovetails, so that the insert can be substantially circumferentially and substantially radially restrained in the slot.

The disc can include a cavity. The slot can open at one end to the cavity. When a blade is received within the cavity, one end of the insert is proximate the blade, axially restraining the insert in the direction of the blade.

The system further includes an elongated vane having a tip at one end. The tip is located proximate a portion of the disc such that, under certain operational conditions, the abrasive material can engage and abrade the tip.

DETAILED DESCRIPTION OF EMBODIMENTS OF THE INVENTION

Embodiments of the invention are directed to a system that can improve engine performance by minimizing vane tip clearances while reducing the risk of significant component damage in the event of vane tip rubbing. Aspects of the invention will be explained in connection with one possible system, but the detailed description is intended only as exemplary. Embodiments of the invention are shown in FIGS. 3-6, but the present invention is not limited to the illustrated structure or application.

Figure 1:
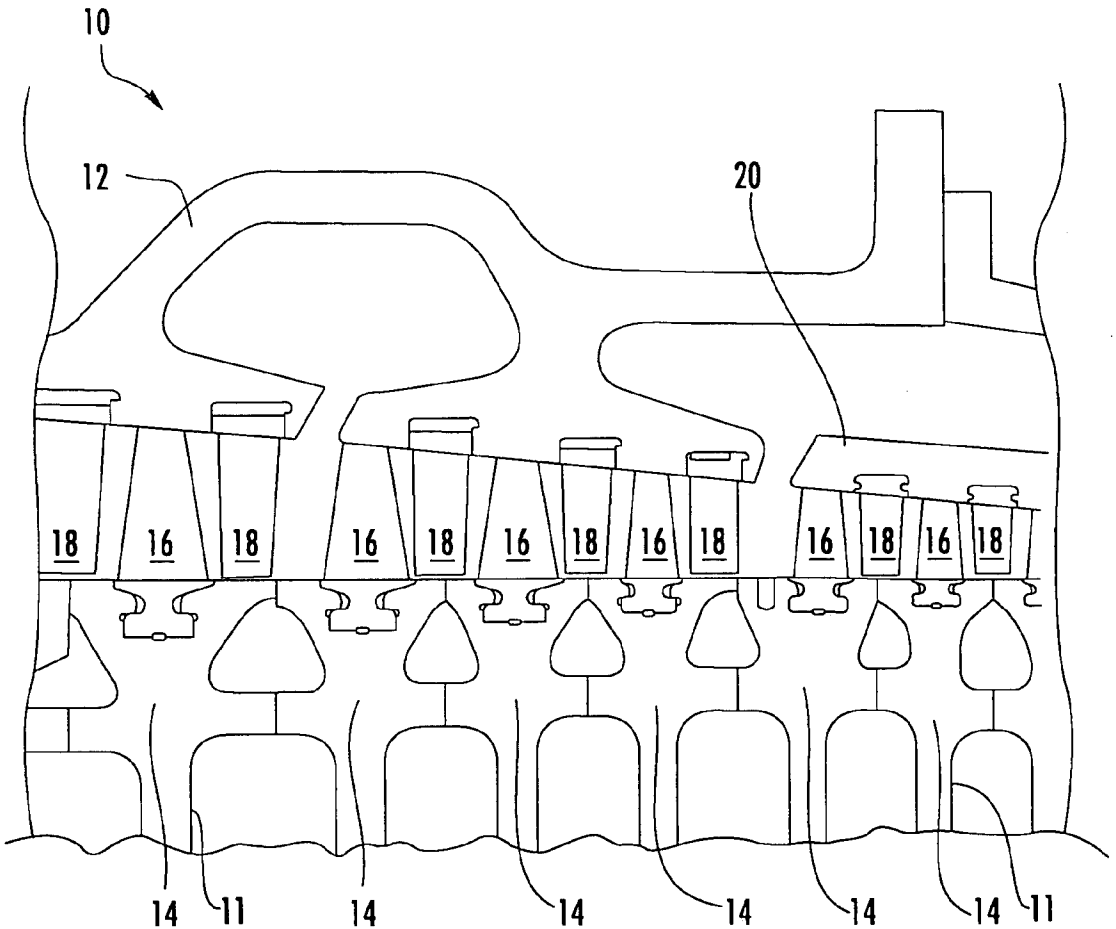
FIG. 1 PRIOR ART
FIG. 1 is a cross-sectional view of a portion of a compressor section of a known turbine engine.
Figure 2:
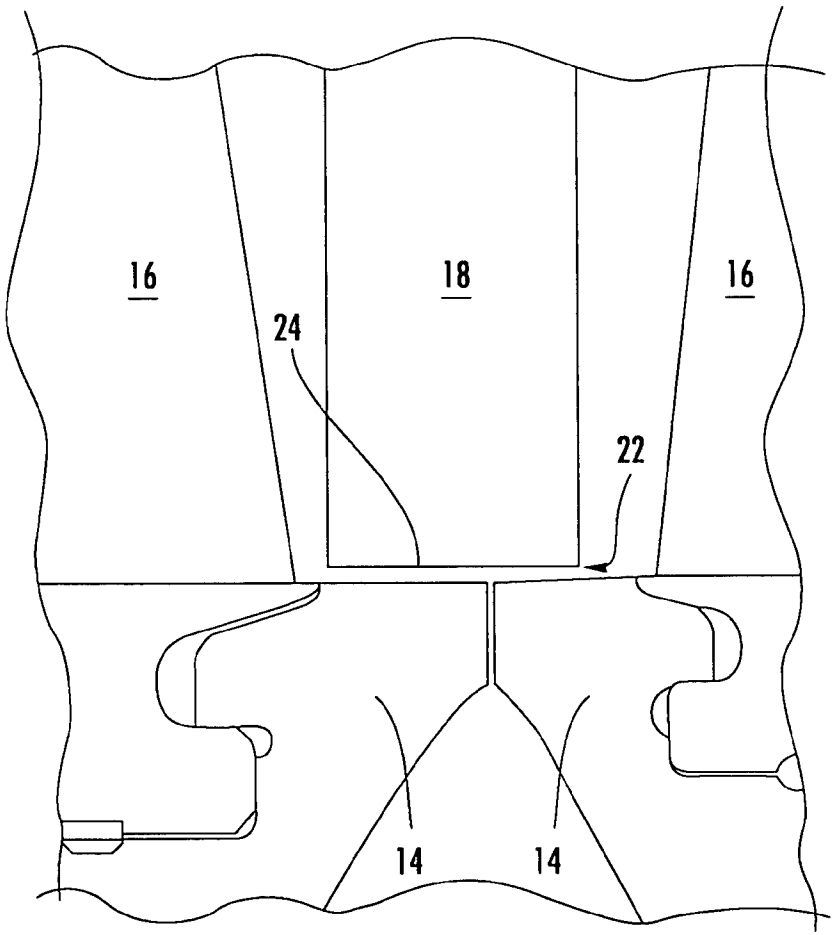
FIG. 2 PRIOR ART
FIG. 2 is a cross-sectional view of the interface between a rotating blade and a pair of compressor discs in a known turbine engine.
Figure 3:
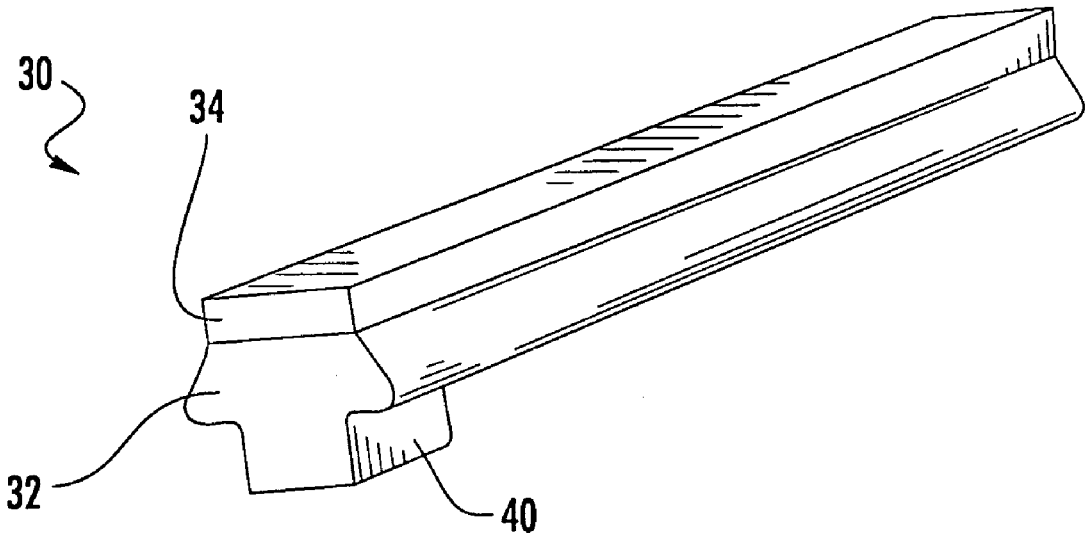
FIG. 3 is an isometric view of an abrasive insert according to aspects of the invention.
Figure 5:
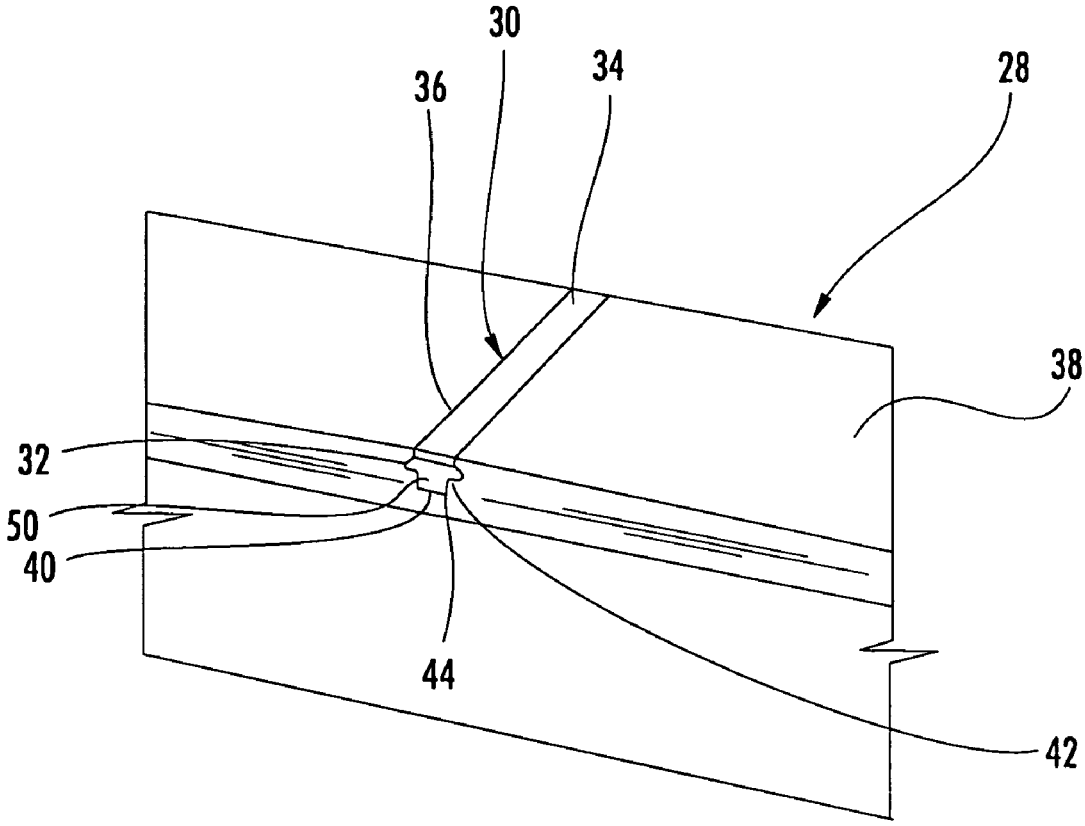
FIG. 5 is a close up view of a portion of a rotor disc assembly according to aspects of the invention, showing an abrasive insert attached to the disc.

According to aspects of the invention, an abrasive material can be attached to compressor rotor disc and is positioned such that, in the event of vane tip rubbing, the abrasive material will come into contact with the vane tip. In one embodiment, as shown in FIG. 5, the abrasive material can be provided in the form of an insert 30 that is attached to a compressor rotor disc 28. At least a portion of the insert 30 can be made of an abrasive material. Referring to FIG. 3, the insert 30 can, in one embodiment, include a base 32 with an abrasive material 34 thereon. The base 32 can be made of metal or other suitable material. Preferably, the base 32 is made of the same material as the rotor disc 28 or at least of a material that is thermally compatible with the material of the rotor disc 28. As will be explained in more detail below, the base 32 can have any shape or configuration to facilitate attachment to the rotor disc 28.

The abrasive material 34 can be any suitable abrasive. The abrasive material 34 can be, for example, cubic boron nitride, silicon carbide, silicon nitride, alumina, zirconia, diamond, or mixtures thereof. Ideally, the abrasive material 34 has a Mohs hardness of at least about 9. The abrasive material 34 can be attached to the base 32 in any suitable manner. Because the insert 30 is relatively small, the abrasive material 34 can be electroplated to the base 32. In contrast, it would not be feasible to electroplate an abrasive coating onto a large rotor disc. Alternatively, the abrasive material 34 can be applied to the base 32 by a thermal spray process. The abrasive material 34 can have any suitable thickness. In one embodiment, the thickness of the abrasive material 34 can be about 0.005 inches.

The abrasive insert 30 can be attached to the rotor disc 28 in any of a number of ways. Preferably, the insert 30 is removably attached to the disc 28 to facilitate removal and replacement of the insert 30 during field service. For instance, the insert 30 can threadably engage the disc 28. Alternatively, as shown in FIG. 5, the insert 30 can be received in a slot 36 formed in the rotor disc 28. For convenience, the following discussion will be directed to such an arrangement. However, it will be understood that such an arrangement is merely an example, and aspects of the invention are not limited to any specific manner of attachment between the rotor disc 28 and the insert 30.

Figure 4:
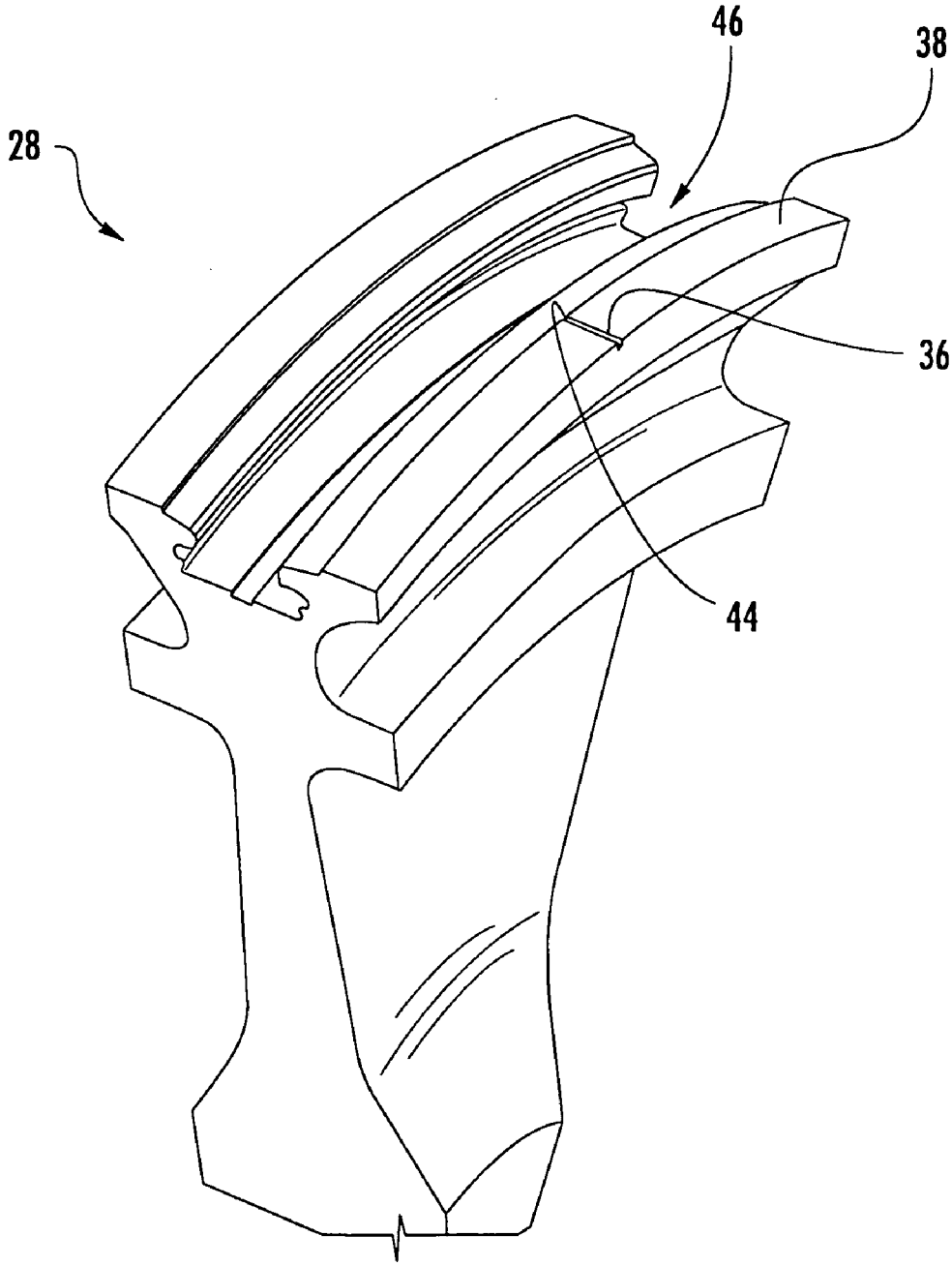
FIG. 4 is an isometric view of a portion of a rotor disc configured in accordance with aspects of the invention.

Referring to FIG. 4, the rotor disc 28 can have at least one slot 36. In one embodiment, there can be from two to eight inserts 30. When there is a plurality of slots 36, the slots 36 can be arranged about the compressor disc 28 as desired. In one embodiment, the plurality of slots 36 can be substantially equally spaced about an outer peripheral surface 38 of the disc 28. The arrangement of the slots 36 on one disc 28 may or may not be substantially identical to the arrangement of the slots 36 on another disc 28 in the compressor section. The slots 36 can have any suitable shape or configuration. The slot 36 can be elongated and can extend substantially axially along the compressor rotor disc 36. The term "axially" and variants thereof is intended to mean relative to axis of the compressor when the disc 28 is installed in its operational position. The slots 36 can be substantially parallel to each other. The slots 36 can open to the outer peripheral surface 38 of the disc 28. The slots 36 can be formed in the rotor disc 28 by any suitable process, such as by machining.

Each slot 36 can receive a respective one of the abrasive inserts 30. When installed, the abrasive material 34 of the insert 30 can be exposed along with the outer peripheral surface 38 of the rotor disc 28. The insert 30 and/or slot 36 can be configured such that the abrasive material 34 can extend beyond the outer peripheral surface 38 of the rotor disc 28 in the radial direction. In one embodiment, the base 32 of the insert 30 can be substantially flush with the outer peripheral surface 38 of the rotor disc 28, and the entire abrasive material 34 can protrude beyond the outer peripheral surface 38 of the rotor disc 28.

The insert 30 and the slot 36 can be configured for substantial mating engagement. Preferably, the insert 30 engages the slot 36 so as to be retained therein. The slot and the insert 30 can be configured to provide restraint in the axial, radial and/or circumferential directions. In one embodiment, the base 32 of the insert 30 and the slot 36 can be configured as a dovetail or "fir tree." In such case, the engagement between the insert 30 and the slot 36 can substantially circumferentially restrain the insert 30. In addition, such an arrangement can radially restrain the insert 30, which is subjected to centrifugal forces during engine operation. It will be readily appreciated that there are numerous configurations for the insert 30 and/or slot 36 that can achieve radial and/or circumferential restraint.

Movement of the insert 30 can also be restrained in the axial upstream and the axial downstream directions. In one embodiment, the base 32 can include a protrusion 40 that extends generally transverse to the rest of the base 32. The protrusion 40 can be located at one end of the base 32. The protrusion 40 can engage a portion of the slot 36, such as a recess, notch or step 42 therein, to restrain the insert 30 in one of the axial directions. Restraint in the opposite axial direction can be achieved in a similar manner or in a different manner. For instance, an end 44 of the slot 36 can open to a cavity 46 in the rotor disc 28 that receives a compressor blade 48. Thus, when the insert 30 and the compressor blade 48 are installed, an end 50 of the insert 30 can be substantially adjacent to the compressor blade 48 such that axial movement of the insert 30 in the axial direction toward the compressor blade 48 is obstructed by the compressor blade 48 itself. The end 50 of the insert 30 can also be the end that includes the protrusion 40.

Figure 6:
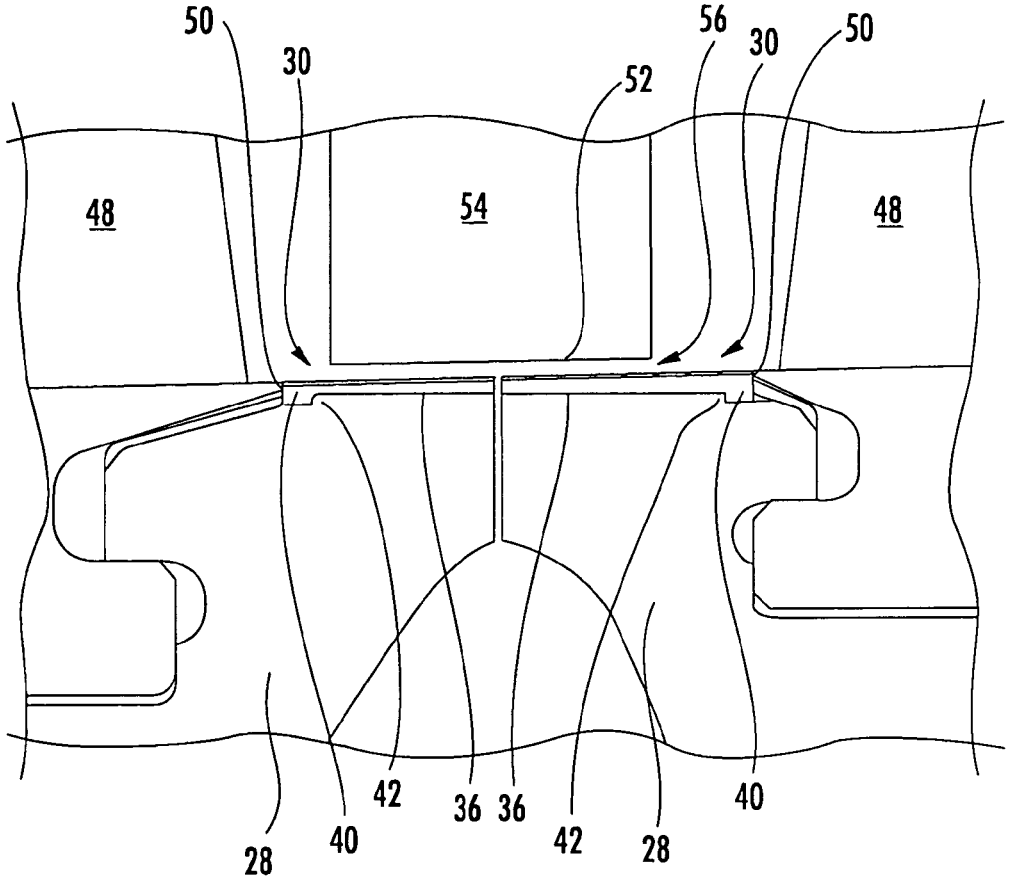
FIG. 6 is a cross-sectional view of a rotor disc assembly according to aspects of the invention.

Referring to FIG. 6, compressor disc 28 with the abrasive insert 30 can act like a grinding wheel in operational modes where a tip portion 52 of a vane 54 rubs against the rotating disc 28. As a result, the abrasive insert 30 abrades or otherwise wears away the vane tip 52. Because the abrasive insert 30 is provided on the rotor disc 28, only those vanes 54 that are causing the interference issue are worn. Thus, the vane tip clearance 56 is minimized, and the risk of damage to the disc 28 and the vane 54 has been substantially reduced. If the inserts 30 are damaged or become excessively worn, an outage can be scheduled for repair or replacement of the inserts 30. Likewise, if any vanes 54 need to be replaced, the inserts 30 can be replaced as well so that the new vanes 54 can be worn.

It can be envisioned that an abrasive material can be attached to the vane tip instead of the rotor disc. In such case, the abrasive material would wear the rotor disc; however, such a system can have a number of drawbacks. First, the rotating disc is subjected to centrifugal loads during engine operation. These additional forces significantly raise concerns of portions of the rotor disc liberating upon contact with the abrasive material, which can cause significant engine damage. Further, the friction between the abrasive material and the rotor discs can heat treat the rotor disc material, thereby adversely affecting the properties of the material. Attaching an abrasive material to the tip of a vane, particularly a shrouded vane, is complex, costly and the performance is not expected to be as good.

If the abrasive material is attached to the stationary vane tip, then any rubbing between a vane tip (even a single vane) and the rotor disc would result in a 360 degree groove being formed in the abradable outer peripheral surface of the rotor disc. Consequently, there would be overly large clearances in areas where such clearances are not needed. On the other hand, if the abrasive material is attached to the rotor disc in accordance with aspects of the invention, then the only areas affected are those in which a vane tip clearance problem arises. For instance, if a vane tip rubbing event occurs between the rotor disc and only one of the plurality of blades, then only that blade would be worn away. The other blades would not be worn away unless and until they contact the rotor disc.

Moreover, there are a number of reasons as to why it is more important to protect the rotor disc as opposed to the vanes. First, rotor discs are substantially more expensive than the airfoils. Second, it is relatively easy to replace a vane whereas the removal and replacement of the rotor discs is a time consuming, labor intensive and expensive task. Third, there is a possibility of increased warranty claims because turbine engine service agreements commonly guarantee the rotor disc over a longer period than the vanes.

The foregoing description is provided in the context of one possible system for including an abrasive material on a disc. The system can be used on one or more of the discs in the compressor section of the engine. While well suited for the compressor section of a turbine engine, aspects of the invention can be readily applied to the turbine section of the engine as well. Thus, it will of course be understood that the invention is not limited to the specific details described herein, which are given by way of example only, and that various modifications and alterations are possible within the scope of the invention as defined in the following claims.

What is claimed is:

1. A rotor disc assembly comprising: a turbine engine rotor disc; the disc having an outer peripheral surface; an insert positioned in a substantially axially extending slot, wherein the slot forms an opening in the outer peripheral surface of the disc, said slot having at least one open end, and said insert and slot being configured to achieve circumferential restraint of the insert; and an abrasive material positioned on an outer surface of the insert that faces radially outward such that the abrasive material forms a portion of the outer peripheral surface of the rotor disc.

2. The assembly of claim 1 wherein the abrasive material is at least one of cubic boron nitride, silicon carbide, silicon nitride, alumina, zirconia or diamond.

3. The assembly of claim 1 wherein the abrasive material has an associated Mohs hardness of at least about 9.

4. The assembly of claim 1 wherein at least a portion of the abrasive material protrudes beyond the outer peripheral surface of the rotor disc.

5. The assembly of claim 1 wherein the insert is restrained in the slot substantially circumferentially and substantially radially.

6. The assembly of claim 5 wherein the base and the slot are configured as dovetails.

7. The assembly of claim 1 wherein the insert is restrained in at least one of the axial upstream direction and the axial downstream direction.

8. The assembly of claim 7 wherein the base includes a transverse protrusion and the slot is contoured to substantially matingly engage the protrusion, whereby the insert is restrained in at least one of the axial upstream direction and the axial downstream direction.

9. The assembly of claim 1 wherein the abrasive material is provided at a plurality of locations substantially equally spaced about the outer peripheral, surface of the rotor disc.

10. The assembly of claim 1 wherein the abrasive material extends substantially axially along the rotor disc.

11. A vane tip clearance system comprising: a rotating disc having an outer peripheral surface, the disc having a slot therein, the slot opening to the outer peripheral surface of the disc, said slot having at least one open end, and said insert and slot being configured to achieve circumferential restraint of the insert; an insert with a base and an abrasive material attached to the base, wherein the insert is retainably received in the slot such that the abrasive material is at least flush with the outer peripheral surface of the disc; wherein the insert extends substantially axially along the rotor disc; an elongated vane having a tip at one end, the tip being proximate a portion of the disc, whereby the abrasive material can engage and abrade the tip; and wherein the base includes a transverse protrusion and the slot is contoured to substantially matingly engage the protrusion, whereby the insert is restrained in at least one of the axial upstream direction and the axial downstream direction.

12. The system of claim 11 wherein the abrasive material is at least one of cubic boron nitride, silicon carbide, silicon nitride, alumina, zirconia or diamond.

13. The system of claim 11 wherein the abrasive material has an associated Mohs hardness of at least about 9.

14. The system of claim 11 wherein the disc includes a cavity, and further including a blade received within the cavity, wherein the slot opens at one end to the cavity such that one end of the insert is proximate the blade, whereby the insert is restrained in an axial direction toward the blade.

15. The system of claim 11 wherein the abrasive material protrudes beyond the outer peripheral surface of the disc.

16. The system of claim 11 wherein the base and the slot are configured as dovetails, whereby the insert is substantially circumferentially and substantially radially restrained in the slot.

* * * * *